US006779785B2

(12) United States Patent
Warner

(10) Patent No.: US 6,779,785 B2
(45) Date of Patent: Aug. 24, 2004

(54) SELF-RELIEVING CHOKE ADJUSTMENT APPARATUS

(75) Inventor: Donald W. Warner, Cass City, MI (US)

(73) Assignee: Walbro Engine Management, L.L.C.

( * ) Notice: Subject to any disclaimer, the term of this patent is extended or adjusted under 35 U.S.C. 154(b) by 0 days.

(21) Appl. No.: 10/205,385

(22) Filed: Jul. 25, 2002

(65) Prior Publication Data

US 2004/0017015 A1 Jan. 29, 2004

(51) Int. Cl.[7] ..... F02M 1/14
(52) U.S. Cl. ..... 261/64.1; 261/64.6
(58) Field of Search ..... 261/64.6, 64.1, 261/64.4

(56) References Cited

U.S. PATENT DOCUMENTS 2,982,275 A * 5/1961 Doman et al. ..... 123/198 DC
3,837,322 A * 9/1974 Shishido et al. ..... 123/274
3,906,911 A * 9/1975 Nakada et al. ..... 261/39.1
3,928,511 A * 12/1975 Atsumi et al. ..... 261/64.4
3,948,240 A * 4/1976 Hirosawa et al. ..... 123/179.16
4,005,690 A * 2/1977 Hirosawa et al. ..... 261/39.6
4,439,377 A * 3/1984 Nartowski ..... 261/52
4,788,014 A * 11/1988 Kanno ..... 261/39.2
6,619,632 B2 * 9/2003 Suzuki ..... 261/64.4

FOREIGN PATENT DOCUMENTS

JP 58-117340 * 7/1983 ..... 261/64.6

* cited by examiner

*Primary Examiner*—Richard L. Chiesa
(74) *Attorney, Agent, or Firm*—Reising, Ethington, Barnes, Kisselle, P.C.

(57) ABSTRACT

A self-relieving choke adjustment apparatus for an internal combustion engine carburetor including a choke valve body and a choke mixing passage formed in the valve body. A choke plate is supported in the mixing passage for pivotal motion about a parallel choke plate axis between an open position and a closed position, such that airflow through the mixing passage tends to rotate the choke plate toward the open position. A rotary biasing element is connected between the choke plate and the choke body and applies a torque biasing the choke plate toward its closed position. The apparatus also includes a choke adjustment lever supported for pivotal motion relative to the choke plate about the choke plate axis and rotationally engaging the biasing element such that lever rotation against the biasing force of the biasing element causes the biasing torque applied to the choke plate by the biasing element to increase thus increasing the amount of airflow required to rotate the choke plate out of its closed position and decreasing the number of degrees the choke plate will be forced open by a given amount of airflow through the mixing chamber.

11 Claims, 2 Drawing Sheets

SELF-RELIEVING CHOKE ADJUSTMENT APPARATUS

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

This invention relates generally to an apparatus for adjusting a self-relieving choke for an internal combustion engine carburetor.

DESCRIPTION OF THE RELATED ART INCLUDING INFORMATION DISCLOSED UNDER 37 CFR 1.97 AND 1.98

Self-relieving chokes are well-known in the art. A choke of this type will generally include a choke mixing passage formed in a valve body with a choke plate supported in the mixing passage. The choke plate is supported for pivotal motion about a parallel choke plate axis between an open position and a closed position, such that airflow through the mixing passage tends to rotate the choke plate toward the open position. A rotary biasing element connected between the choke plate and the choke body applies a torque biasing the choke plate toward its closed position.

What such chokes lack is a means for adjusting choke operation to account for variations in air density due to, for example, changes in air temperature.

BRIEF SUMMARY OF THE INVENTION

A self-relieving choke adjustment apparatus for an internal combustion engine carburetor. The apparatus includes a choke in a mixing passage formed in a valve body. A choke plate is supported in the mixing passage for pivotal motion about a parallel choke plate axis between an open position and a closed position, such that airflow through the mixing passage tends to rotate the choke plate toward the open position. A rotary biasing element is connected between the choke plate and the valve body. The biasing element applies a torque biasing the choke plate toward its closed position. A choke adjustment lever is supported for pivotal motion relative to the choke plate about the choke plate axis. The choke adjustment lever rotationally engages the biasing element such that rotation of the lever against the biasing force of the biasing element changes the biasing torque applied to the choke plate by the biasing element.

Objects, features and advantages of this invention include providing a self-relieving choke adjustment apparatus that allows an operator to compensate for air temperature changes by adjusting the carburetor to change the amount of airflow required to rotate the choke plate out of its closed position, and to adjust or alter the number of degrees the choke plate will be forced open by a given amount of airflow through the mixing chamber.

BRIEF DESCRIPTION OF THE SEVERAL VIEWS OF THE DRAWINGS

These and other objects, features and advantages of this invention will be apparent from the following detailed description of the preferred embodiment(s) and best mode, appended claims, and accompanying drawings in which:

DETAILED DESCRIPTION OF INVENTION EMBODIMENT(S)

Figure 1:
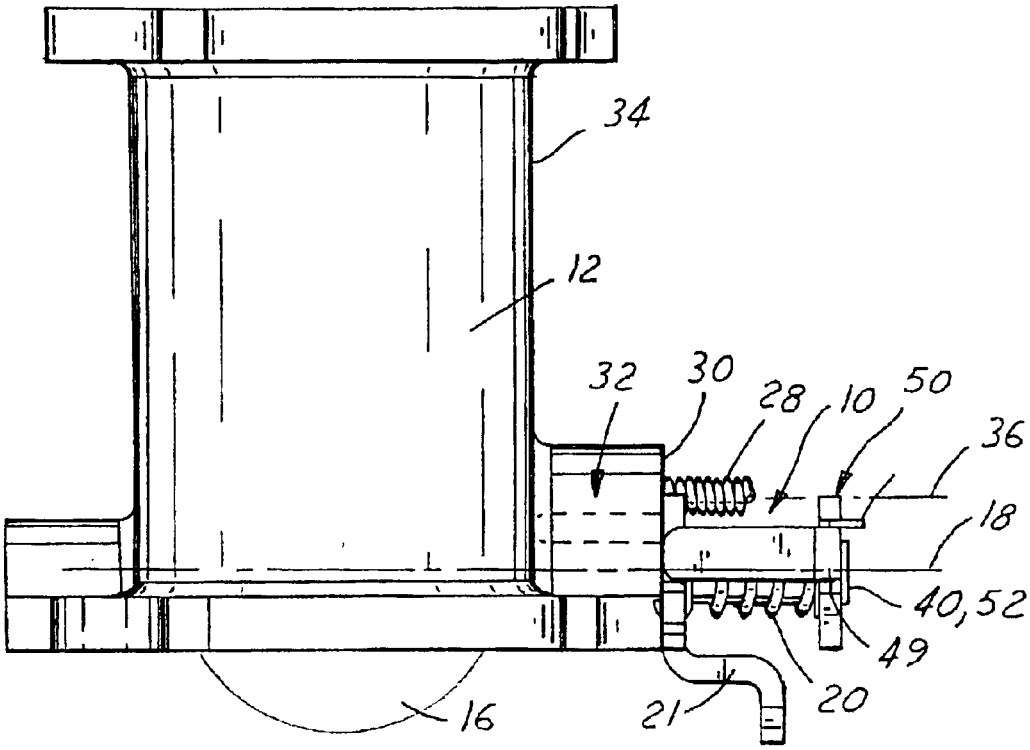
FIG. 1 is an exploded front view of a self-relieving choke including a self-relieving choke adjustment apparatus constructed according to one embodiment of the invention and showing a choke plate of the apparatus in an open position.

A self-relieving choke adjustment apparatus for an internal combustion engine carburetor is generally indicated at 10 in the drawings. The apparatus includes a choke valve or carburetor body 12 and a mixing passage 14 formed in the carburetor body 12. The apparatus 10 also includes a choke plate 16 supported in the mixing passage 14 for pivotal motion about a parallel choke plate axis 18. The choke plate 16 moves between an open position allowing maximum airflow through the mixing passage 14 and a closed position preventing airflow through the mixing passage 14. In the drawings. the choke plate 16 is shown in the open position.

Figure 2:
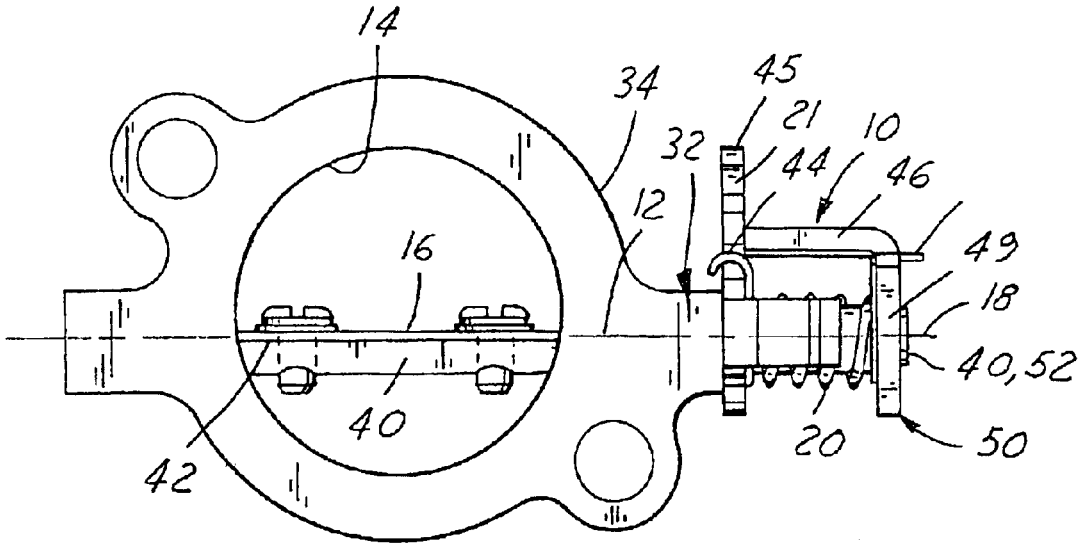
FIG. 2 is a bottom end view of the self-relieving choke of FIG. 1.

As best shown in FIG. 2 the choke plate axis 18 is positioned off-center, i.e., is displaced from a centroid of the choke plate 16. such that airflow through the mixing passage 14 tends to rotate the choke plate 16 toward the open position shown in the drawings. A rotary biasing element 20 is connected between the choke plate 16 and the body 12. The biasing element 20 applies a torque that biases the choke plate 16 away from the open position shown in the drawings and toward its closed position.

The apparatus 10 also includes a choke adjustment lever 21 supported for rotation on the choke valve body 12 as shown in FIGS. 1 and 2. The choke adjustment lever 21 pivots relative to the choke plate 16 about the choke plate axis 18.

The choke adjustment lever 21 is positioned to rotationally engage the biasing element 20 such that rotation of the lever 21 against the biasing force of the biasing element 20 causes the biasing element 20 to "wind up" and increase the biasing torque applied to the choke plate 16 by the biasing element 20. This increases the amount of airflow required to rotate the choke plate 16 out of its closed position. It also decreases the number of degrees the choke plate 16 will be forced to open by a given amount of airflow in the mixing passage 14.

Figure 3:
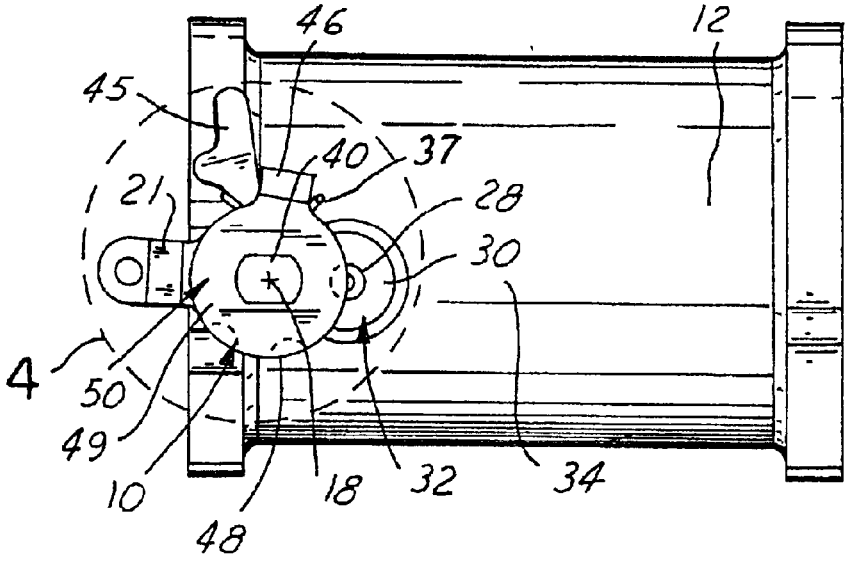
FIG. 3 is a side view of the self-relieving choke of FIG. 1.
Figure 4:
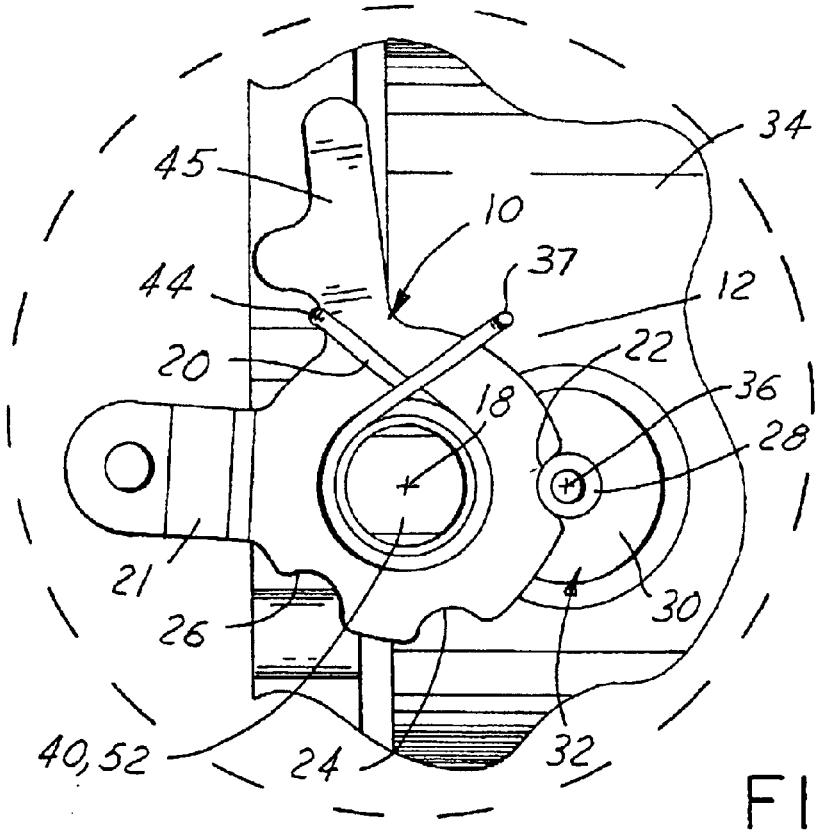
FIG. 4 is a magnified view of the region bounded by circle 4 in FIG. 3.

As shown in FIG. 4, the choke adjustment lever 21 includes first, second and third circumferentially spaced lever detents 22, 24, 26. The apparatus 10 includes a stationary detent in the form of a spring 28 positioned as shown in FIGS. 1, 3 and 4 to engage whichever of the lever detents 22, 24, 26 is rotated into alignment with the spring 28. In the drawings, and as shown most clearly in FIG. 4, the detent spring 28 is engaged in the first lever detent 22. The stationary detent spring 28 can therefore releasably secure the choke adjustment lever 21 at three pre-determined points of rotation to provide three pre-determined amounts of biasing torque to the choke plate 16. In other embodiments the choke adjustment lever 21 may include only two lever detents or any number of detents exceeding the three lever detents 22, 24, 26 shown in the present embodiment.

When the choke adjustment lever 21 is moved from a position with the first lever detent 22 engaging the stationary detent spring 28, as shown, to a position in which the second 24 and then the third 26 of the three lever detents 22, 24, 26 engages the stationary detent spring 28, the biasing element 20 wraps more tightly and applies a greater amount of biasing torque to the choke plate 16 through the choke adjustment lever 21. The farther the choking engagement lever 21 is rotated in this direction, the greater the biasing torque applied to the choke plate 16 through the choke adjustment lever 21.

The stationary detent spring 28 is a coil spring as best shown in FIG. 1 and is supported on and extends outward from an outer sidewall 30 of a cylindrical abutment 32 that integrally extends radially outward from an outer sidewall 34 of the choke valve body 12. The stationary detent spring 28 has a detent spring axis 36 disposed generally parallel to the choke plate axis 18. The detent spring 28 is configured to flex laterally sufficiently to allow itself to be forced out of any of the latch detents 22, 24, 26 as an operator manually rotates the choke adjustment lever 21. In other embodiments, any other suitable means of engaging a structure such as the choke adjustment lever 21 may be used in place of the spring and detent means shown in the drawings and described above.

As best shown in FIG. 1, the apparatus 10 includes a choke control shaft 40 pivotally supported in the choke valve body 12. The choke control shaft 40 is connected to and extends across a back surface 42 of the choke plate 16 and extends axially from the choke plate 16. The choke control shaft pivotally supports the choke plate 16 across the mixing passage 14.

In the embodiment shown, the rotary biasing element 20 is a torsion spring having a first end 44 hooked around a radially extending arm 45 of the choke adjustment lever 21 as best shown in FIGS. 2 and 4. A second end 37 of the biasing element torsion spring 20 hooks around a tab 46 that extends axially from a circumferential edge 48 of a disk-shaped portion 49 of a choke shaft lever 50 fixed to an outer end 52 of the choke control shaft. The choke shaft lever 50 increases the amount of torque that the biasing element 20 can apply to the choke shaft 40 by increasing the length of the torque lever arm. The interface between the second end 37 of the biasing element 20 and the choke shaft lever 50 is shown in FIGS. 1–3.

In practice, when the ambient temperature drops sufficiently to significantly increase air density. an operator can compensate by moving the choke adjustment lever 21 to a position where a higher numbered lever detent 24, 26 is engaging the stationary detent spring 28. This will cause the biasing spring 20 to wind more tightly and exert greater biasing torque on the choke plate 16 through the choke shaft lever 50 and the choke shaft 40. As such, when the engine is operating, for any given amount of air pressure, the increased torque will restrain the choke plate 16 from rotating and opening as far and from admitting as much air into the mixing passage 14 as it would have done with a lower-numbered detent engaging the stationary detent spring 28. By reducing the flow rate of denser incoming air, a more optimum fuel air mixture can be maintained.

This description is intended to illustrate certain embodiments of the invention rather than to limit the invention. Therefore, it uses descriptive rather than limiting words. Obviously, it's possible to modify this invention from what the description teaches. Within the scope of the claims, one may practice the invention other than as described.

I claim:

1. A self-relieving choke adjustment apparatus of a carburetor for an internal combustion engine, the apparatus comprising:

a carburetor body;

a mixing passage formed in the body;

a choke plate supported in the mixing passage for movement between an open position and a closed position so that airflow through the mixing passage due to operation of the engine moves the choke plate to the open position;

a biasing spring operably connected to the choke plate and configured to apply a torque biasing the choke plate to its closed position when there is no airflow through the mixing passage; and a choke adjustment lever supported for movement relative to the choke plate and operably connected to the biasing spring such that movement of the adjustment lever changes the biasing torque applied to the choke plate by the biasing spring.

2. A self-relieving choke adjustment apparatus as defined in claim 1 in which:

the choke adjustment lever includes at least two circumferentially-spaced lever detents; and the apparatus includes a stationary detent positioned to engage the lever detents when the lever is rotated and to releasably secure the choke adjustment lever at predetermined points of rotation.

3. A self-relieving choke adjustment apparatus as defined in claim 1 in which:

the apparatus includes a choke control shaft connected to and extending axially from the choke plate and pivotally supporting the choke plate for motion about a parallel choke axis;

the choke adjustment lever is supported for pivotal motion relative to the choke plate about the choke plate axis; and the biasing spring is configured to apply biasing force in the form of torque to the choke plate through the choke control shaft.

4. A self-relieving choke adjustment apparatus as defined in claim 3 in which:

the apparatus includes a choke shaft lever fixed to and extending generally radially from the choke control shaft; and the biasing element is connected to the choke control shaft via engagement with the choke shaft lever.

5. A self-relieving choke adjustment apparatus of a carburetor for an internal combustion engine, the apparatus comprising:

a carburetor body;

a mixing passage formed in the body;

a choke plate supported in the mixing passage for movement between an open position and a closed position so that airflow through the mixing passage due to operation of the engine moves the choke plate to the open position;

a biasing element operably connected to the choke plate and configured to apply a force biasing the choke plate to its closed position when there is no airflow through the mixing passage; and a choke adjustment lever supported for movement relative to the choke plate and operably connected to the biasing element such that movement of the adjustment lever changes the biasing torque applied to the choke plate by the biasing element, the choke plate is supported for pivotal motion between its open position and closed positions about a parallel choke plate axis;

the choke adjustment lever includes at least two circumferentially-spaced lever detents;

the apparatus includes a stationary detent positioned to engage the lever detents when the lever is rotated and to releasably secure the choke adjustment lever at predetermined points of rotation; and the stationary detent includes a coil spring having an axis disposed generally parallel to the choke plate axis and configured to flex sufficiently to allow an operator to manually rotate the choke adjustment lever to disengage one of the lever detents from the stationary detent.

6. A self-relieving choke adjustment apparatus of a carburetor for an internal combustion engine, the apparatus comprising:

a carburetor body;

a mixing passage formed in the body;

a choke plate supported in the mixing passage for movement between an open position and a closed position so that airflow through the mixing passage due to operation of the engine moves the choke plate to the open position;

a biasing element operably connected to the choke plate and configured to apply a torque biasing the choke plate to its closed position when there is no airflow through the mixing passage;

a choke adjustment lever supported for movement relative to the choke plate and operably connected to the biasing element such that movement of the adjustment lever changes the biasing torque applied to the choke plate by the biasing element; and the apparatus includes a choke control shaft connected to and extending axially from the choke plate and pivotally supporting the choke plate for motion about a parallel choke axis;

the choke adjustment lever is supported for pivotal motion relative to the choke plate about the choke plate axis; and the biasing element is configured to apply biasing force in the form f torque to the choke plate through the choke control shaft and comprises a torsion spring having a first end engaging the choke adjustment lever and a second end connected to the choke control shaft.

7. A carburetor with a self-relieving choke for an engine comprising:

a carburetor body;

a mixing passage through the body;

a shaft journalled for rotation, carried by the body and extending transversely through the mixing passage;

a choke plate in the mixing passage, having a centroid and carried by the shaft for movement between a full open position and a closed position, with the centroid of the choke plate offset relative to the axis of rotation of the shaft so that sufficient airflow through the mixing passage produced by operation of the engine moves the choke plate from the closed position to the full open position;

a choke adjustment lever rotatable relative to the choke plate; and a spring operably connected to the shaft to yieldably bias the choke plate to the closed position when the engine is not operating and operably connected with the adjustment lever so that movement of the lever relative to the choke plate changes the force applied by the spring to the shaft to yieldably bias the choke plate toward the closed position whereby the amount of airflow produced by the operating engine which is required to rotate the choke plate out of its closed position and to its full open position can be changed and adjusted by movement of the lever.

8. A carburetor as defined in claim 7 which also comprises at least two spaced-apart recesses carried by the adjustment lever and a detent yieldably engageable with each of the recesses to yieldably retain the adjustment lever in an adjusted position.

9. A carburetor with a self-relieving choke for an engine comprising:

a carburetor body;

a mixing passage through the body;

a shaft journalled for rotation, carried by the body and extending transversely through the mixing passage;

a choke plate in the mixing passage, having a centroid and carried by the shaft for movement between an open position and a closed position, with the centroid of the choke plate offset relative to the axis of rotation of the shaft so that sufficient airflow through the mixing passage produced by operation of the engine moves the choke plate from the closed position toward the open position;

a choke adjustment lever rotatable relative to the choke plate;

a spring operably connected to the shaft to yieldably bias the choke plate to the closed position when the engine is not operating and operably connected with the adjustment lever so that movement of the lever relative to the choke plate changes the force applied by the spring to the shaft to yieldably bias the choke plate toward the closed position whereby the amount of airflow produced by the operating engine which is required to rotate the choke plate out of its closed position can be changed and adjusted by movement of the lever; and the adjustment lever is carried by the shaft for pivotal movement relative to the shaft and the spring is a torsion spring received on the shaft and operably connected with the adjustment lever so that rotation of the adjustment lever changes and adjusts the torsional force applied by the spring to the shaft to yieldably bias the choke plate toward the closed position.

10. A carburetor as defined in claim 9 which also comprises at least three circumferentially spaced recesses on the adjustment lever and a detent yieldably engageable one at a time with each of the recesses.

11. A carburetor with a self-relieving choke for an engine comprising:

a carburetor body;

a mixing passage through the body;

a shaft journalled for rotation, carried by the body and extending transversely through the mixing passage;

a choke plate in the mixing passages having a centroid and carried by the shaft for movement between an open position and a closed position, with the centroid of the choke plate offset relative to the axis of rotation of the shaft so that sufficient airflow through the mixing passage produced by operation of the engine moves the choke plate from the closed position toward the open position;

a choke adjustment lever rotatable relative to the choke plate;

a spring operably connected to the shaft to yieldably bias the choke plate to the closed position when the engine is not operating and operably connected with the adjustment lever so that movement of the lever relative to the choke plate changes the force applied by the spring to the shaft to yieldably bias the choke plate toward the closed position whereby the amount of airflow produced by the operating engine which is required to rotate the choke plate out of its closed position can be changed and adjusted by movement of the lever; and a shaft lever fixed to and extending generally radially from the shaft for rotation in unison therewith and the spring comprises a torsion spring received on the shaft with one end operably connected to the shaft lever and the other end operably connected to the adjustment lever.

* * * * *